US007986279B2

(12) United States Patent
Bruno et al.

(10) Patent No.: US 7,986,279 B2
(45) Date of Patent: Jul. 26, 2011

(54) RING-SLOT RADIATOR FOR BROAD-BAND OPERATION

(75) Inventors: Richmond D. Bruno, Rancho Palos Verdes, CA (US); Arun K. Bhattacharyya, El Segundo, CA (US); Philip L. Metzen, Hermosa Beach, CA (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 916 days.

(21) Appl. No.: 11/901,567

(22) Filed: Sep. 18, 2007

(65) Prior Publication Data

US 2008/0191953 A1 Aug. 14, 2008

(51) Int. Cl.
*H01Q 13/10* (2006.01)

(52) U.S. Cl. ..... 343/769; 343/767; 343/700

(58) Field of Classification Search ..... 343/767, 343/768, 769, 770, 700 MS
See application file for complete search history.

(56) References Cited

U.S. PATENT DOCUMENTS

| | | | | |
|---|---|---|---|---|
| 4,929,959 | A * | 5/1990 | Sorbello et al. | 343/700 MS |
| 5,539,420 | A * | 7/1996 | Dusseux et al. | 343/769 |
| 6,020,852 | A * | 2/2000 | Jostell | 343/700 MS |
| 2004/0113840 | A1 * | 6/2004 | Gottwald et al. | 343/700 MS |
| 2007/0080864 | A1 * | 4/2007 | Channabasappa | 343/700 MS |
| 2007/0205945 | A1 * | 9/2007 | Tatarnikov et al. | 343/700 MS |

FOREIGN PATENT DOCUMENTS

| | | | |
|---|---|---|---|
| JP | 2006033652 | A * | 2/2006 |
| JP | 2006033652 | A * | 2/2006 |

* cited by examiner

*Primary Examiner* — Dieu H Duong
(74) *Attorney, Agent, or Firm* — Carmen Patti Law Group, LLC

(57) ABSTRACT

One embodiment is a ring-slot radiator having: at least one radiating element having a characteristic of dual resonance, double-tuned in which an open ended strip and a cavity are structured to resonate at at least two different frequencies. Another embodiment may have: a ring-slot structure having at least one ring-slot opening on an infinite ground plane that forms a radiating element; a probe-fed strip structure that excites the slot; another ground plane underneath the strip; and a plurality of suppression elements around the ring slot to suppress parallel plate and surface wave modes.

18 Claims, 8 Drawing Sheets

RING-SLOT RADIATOR FOR BROAD-BAND OPERATION

TECHNICAL FIELD

The invention relates generally to ring-slot radiators and, more particularly, to ring-slot radiators that have greater bandwidths than current ring-slot radiators.

BACKGROUND

Phased array antenna systems provide a convenient technique for steering antenna beams electrically. Each phased array system consists of a relatively large number of antenna elements that are separately fed with a radio-frequency (RF) signal to be transmitted. By controlling the relative phase of the RF signal in the separate antenna elements of the array, one can effectively steer a beam emanating from the array. If the array is two-dimensional, the beam may be steered about two axes. It will be understood, of course, that although such antennas are often described in terms pertaining to a transmitting antenna, the same principles also apply to steering a receiving antenna.

Although such antenna systems are well known, in radar and communications systems they have typically employed conventional radiator elements, such as horn antennas, helical antennas, or open-ended waveguide elements. These conventional radiator elements are prohibitively large in size and weight, and are relatively costly to manufacture, especially for operation at millimeter wave frequencies (30-300 GHz). There is a requirement in some applications for phased array antenna systems that have very closely spaced radiator elements, to provide fast scanning of pencil beams over a large search or coverage volume without forming a grating lobe. A grating lobe is an unwanted lobe in the antenna radiation pattern, caused by steering the beam too far in relation to the element spacing.

Use of ring slot radiator elements in phased array systems has been proposed for low frequency applications. For example, U.S. Pat. No. 5,539,415, issued in the name of Phillip L. Metzen et al., discloses an antenna system with an array of ring slot radiators. The same system is disclosed in a paper by Phillip L. Metzen et al., entitled "The Globalstar cellular satellite system," IEEE Trans. Vol AP-46, no. 6, Jun. 1998, pp. 935 942. The antenna array and associated feed probe structure disclosed in these publications is designed for operation in the L-band (1.61 GHz to 1.6265 GHz) and provides a very narrow (1%) bandwidth. Unfortunately, antenna systems of the type disclosed by Metzen et al. do not work at millimeter-wave frequencies, such as 35 GHz or higher. Moreover, the narrow 1% bandwidth is so narrow as to render the design very sensitive to manufacture, resulting in high production costs.

Furthermore, some applications require bandwidths over 10%. However, typical bandwidth of a ring-slot radiating element is less than 5%. Therefore, there is a need for improved ring-slot radiators that have greater bandwidths than current ring-slot radiators.

SUMMARY

One embodiment of the present method and apparatus encompasses an apparatus. The apparatus may comprise: a ring-slot radiator having: at least one radiating element having a characteristic of dual resonance, double-tuned in which an open ended strip and a cavity are structured to resonate at at least two different frequencies. Another embodiment may have: a ring-slot structure having at least one ring-slot opening on an infinite ground plane that forms a radiating element; a probe-fed strip structure that excites the slot; another ground plane underneath the strip; a plurality of suppression elements around the ring slot to suppress parallel plate and surface wave modes.

One embodiment of the present method and apparatus encompasses a method. The method may comprise: forming at least one radiating element having a characteristic of dual resonance, double-tuned in which an open ended strip and a cavity are structured to resonate at least two different frequencies, the at least one radiating element having an associated feed location; and altering at least one of feed location and the at least one radiating element to obtain circular polarization using mode degeneracy.

DESCRIPTION OF THE DRAWINGS

The features of the embodiments of the present method and apparatus are set forth with particularity in the appended claims. These embodiments may best be understood by reference to the following description taken in conjunction with the accompanying drawings, in the several figures of which like reference numerals identify like elements, and in which:

DETAILED DESCRIPTION

Embodiments of ring-slot radiators according to the present method and apparatus achieve over 20% bandwidth that can be realized using low cost dielectric material. As a result the implementation cost is significantly lower than a conventional ring slot radiator.

The bandwidth of a ring-slot radiator is limited by two factors: the high permittivity substrate material and the inherent narrowband cavity which the radiating slot is printed on. For low frequency applications, the high permittivity substrate may be replaced by a low permittivity substrate for bandwidth enhancement. To improve the bandwidth further, a dual resonance, double-tuned, characteristic of the radiating element may be exploited. Also, the open ended strip and the cavity may be designed to resonate at two different frequencies. As a result, the operating bandwidth of the radiator is improved significantly from that of a conventional ring-slot radiator.

Furthermore, an embodiment according to the present method and apparatus may also have dual linear polarization, dual band elements. In such an embodiment, the shape of the patch may be rectangular or elliptical and the shape of the radiating slot changes accordingly. For circular polarization using hybrids, the shape of the patch may be circular or square. For obtaining circular polarization using the principle of mode degeneracy, two different methods may be employed. In the first method, mode-degeneracy can be accomplished by deforming the circular or square patch with notches/ears. In the second method, reactive posts may be placed at a 45-degree location relative to the feed location instead of deforming the patch shape.

Figure 1:
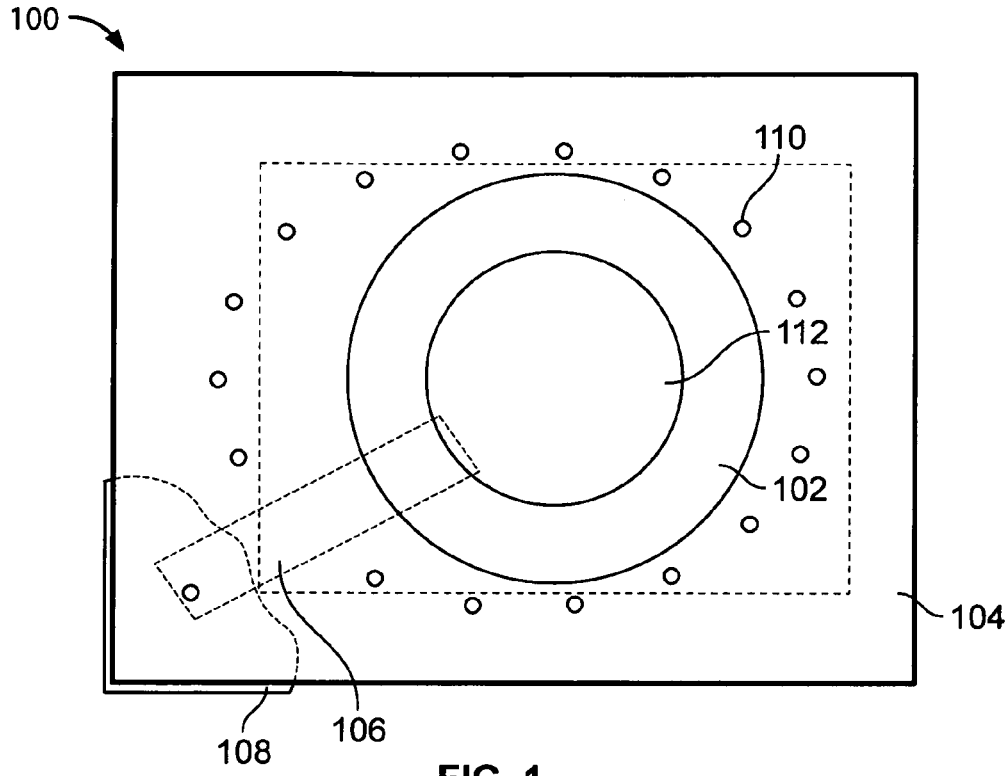
FIG. 1 is a top view of a ring slot radiator for linear polarization operation.

FIG. 1 shows the geometry an embodiment of a ring-slot radiator 100 according to the present method and apparatus. It may consist of a ring-slot opening 102 on an infinite ground plane 104. A rectangular probe-fed strip 106 may excite the ring-slot opening 102. Another ground plane 108 may exist underneath the strip 106. Several vias 110 may exist around the ring-slot opening 102 to suppress parallel plate and the surface wave modes.

In another embodiment, the vias 110 may be replaced by partial conductors of copper or aluminum plated surfaces around the ring-slot opening 102. The substrate material may be a low permittivity material. If an air-substrate is used, a center via may be implemented to hold the circular patch region 112 on the upper ground plane 104. The dimensions of the slot radii of the ring-slot opening 102 and the dimensions of the strip 106 are adjusted to have dual resonance behavior. The probe location is optimized to match with a feed line, which typically has 50 Ohms characteristic impedance. Depending on the application, the patch 112 and the ring-slot opening 102 may be modified to other geometrical shapes, such as rectangular and elliptical. For bandwidth enhancement, another layer of parasitic patches may be added above the radiating slot layer.

Figure 2:
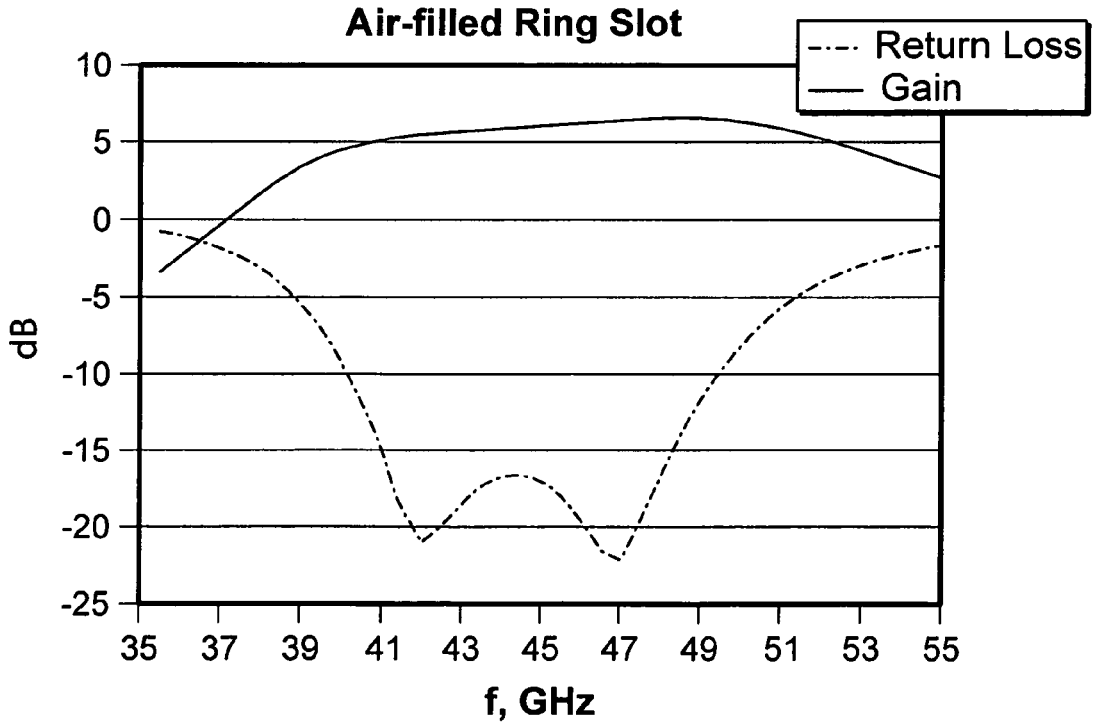
FIG. 2A depicts a generalized version of a 10 dB return loss shown in FIG. 2.

FIG. 2 shows the simulated return loss behavior in an infinite array environment for linear polarization (LP) operation. Also shown in the FIG. 2 is the active bore-sight gain of an element. The elements may be in an equilateral triangular lattice of element spacing about 0.6 wavelengths at the center frequency of the band. Air dielectric substrate may be used with a thickness of about 0.14 wavelengths. About 17 vias may be used. The 10 dB return loss bandwidth may be about 21%. The bore-sight gain at the center frequency may be about 6 dBi, which corresponds to about 100% aperture efficiency.

Figure 2A:
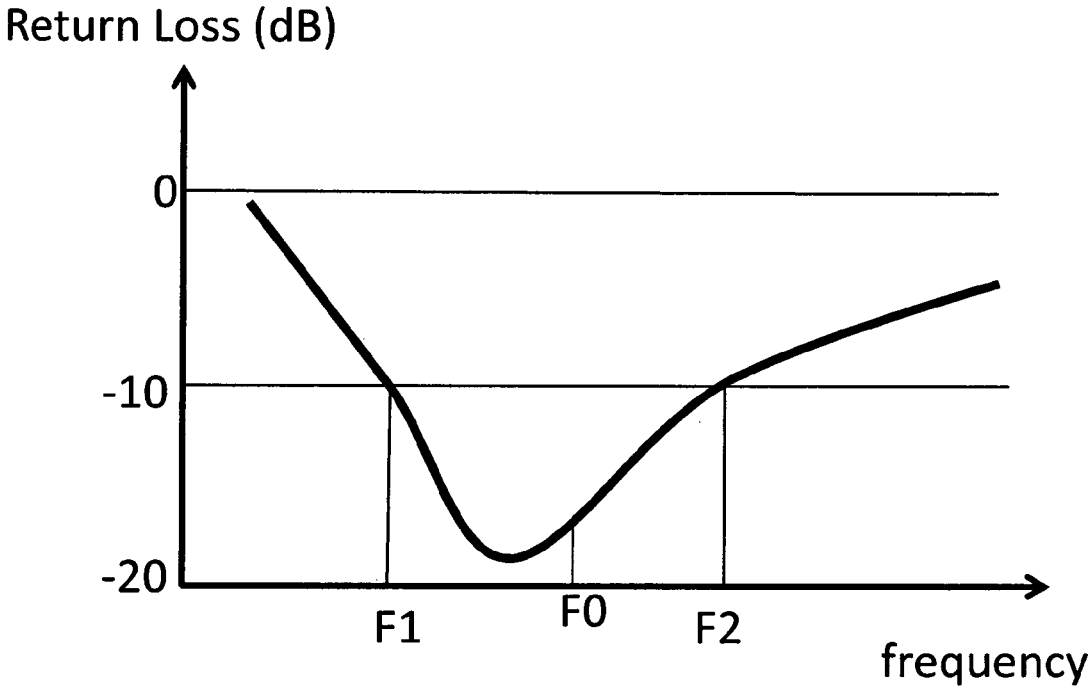

FIG. 2A shows a generalized case of the 10 dB return loss shown in FIG. 2 for the purposes of explanation. A 10 dB return loss bandwidth is defined as being $(F2-F1)/F0 \times 100\%$ where F2 is an upper frequency where the ring-slot radiator shows a −10 dB return loss, F1 is a lower frequency where the ring-slot radiator shows a −10 dB return loss and F0 is the center frequency of the band at which the radiator is being operated.

Figure 3:
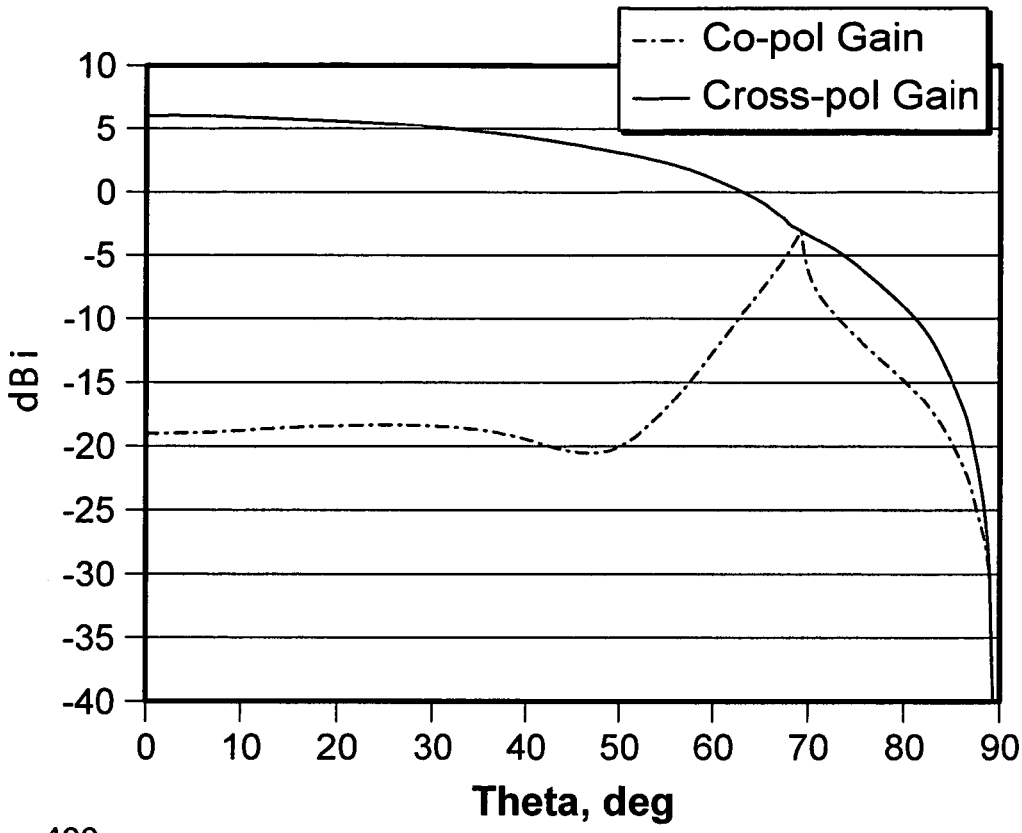
FIG. 3 is an active element pattern plot.

FIG. 3 shows the active element pattern. The worst case cross-polarization level with respect to the co-polarization level is about −20 dB within ±60-degree scan region. This cross-polarization level corresponds to less than 2 dB axial ratio for a circular polarization operation. No blind angle is observed within 80-degree scan angle which is partly due to low permittivity substrate and partly due to ground plane vias surrounding the element.

Figure 4:
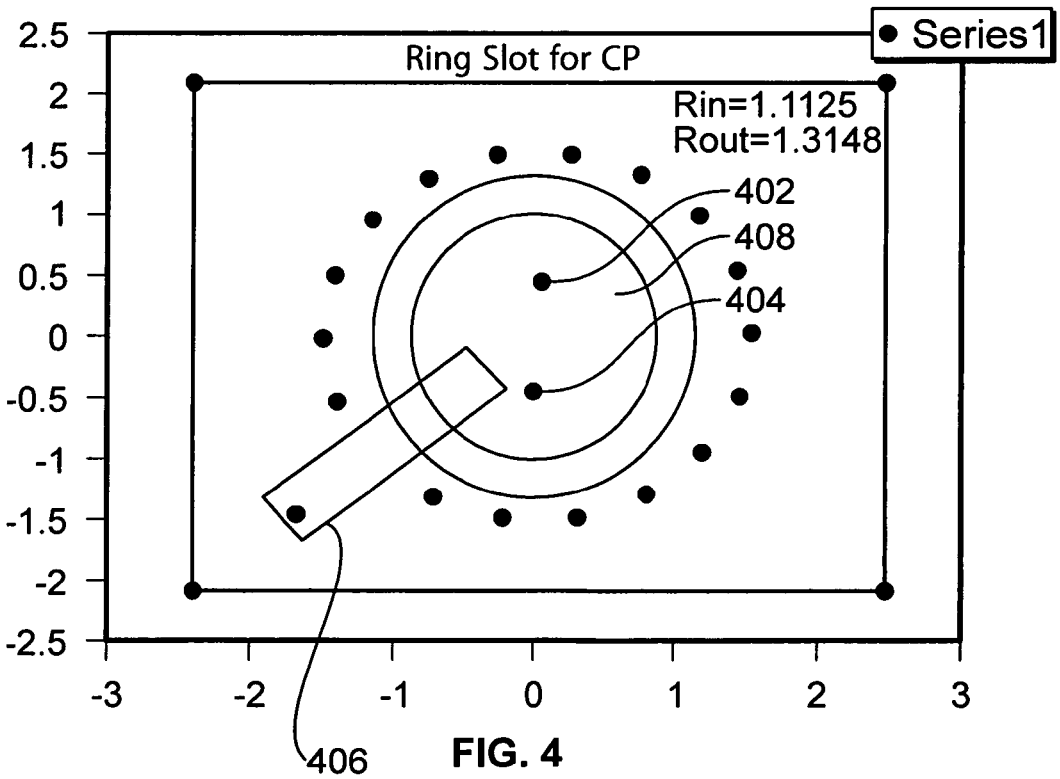
FIG. 4 depicts a modified ring slot for CP operation.

FIG. 4 shows a modification of a ring-slot radiator 400 for generating circular polarization (CP) radiation using the principle of mode degeneracy. Two reactive posts 402, 404 may be placed at 45-degree angles relative to the strip 406 are placed. These reactive posts 402, 404 also act as supports for the patch 408 in the case of an air-filled cavity.

Figure 5:
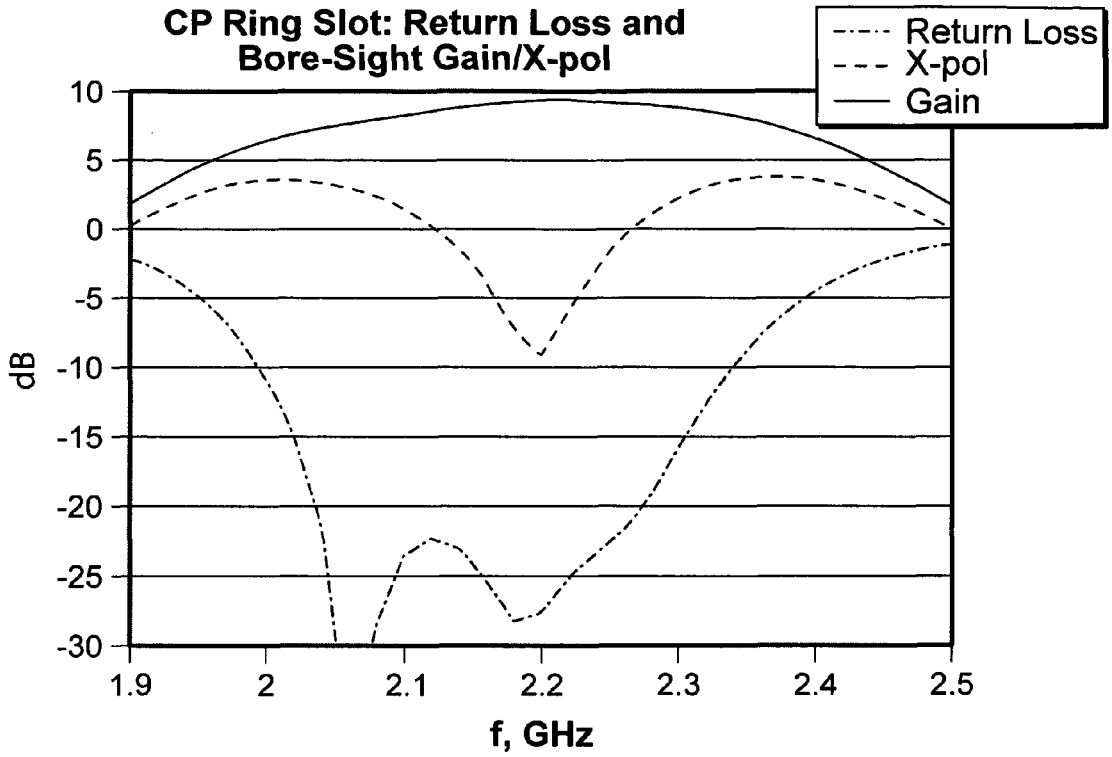
FIG. 5 shows performance of a CP ring slot.

FIG. 5 shows the return loss, gain and cross-polarization performances of the FIG. 4 embodiment. This particular geometry may have a large element spacing of about 0.9 wavelength. The bandwidth may be improved significantly if the element spacing is reduced to about 0.6 wavelength. In another embodiment, notches or ears may be used for generating CP radiation, instead of using posts. Also, a screen polarizer may be used for converting LP to CP. In this case, the radiating element should not have any post or notch, however.

Typical ring slot radiating elements are usually designed and implemented using traditional metal laminated circuit board materials that are printed, etched and laminated for construction. Even with the best circuit board materials their dielectric constant and loss tangent greatly affect the performance of the element. Embodiments of the element described herein may use very thin low-loss circuit board materials, with the element and plated through holes, suspended above a precisely defined cavity.

Figure 6:
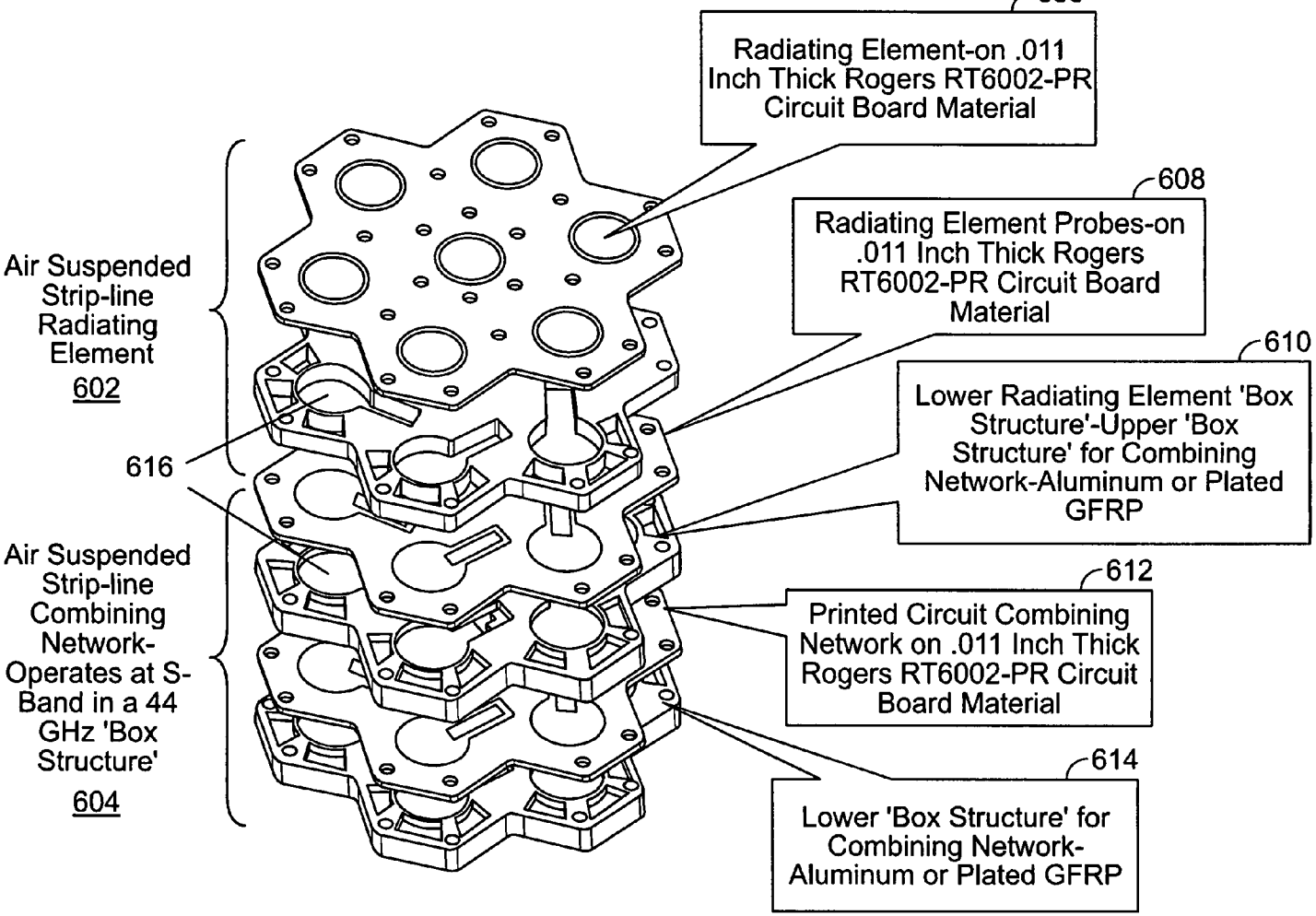
FIG. 6 is an exploded view of a radiating element circuit board.

FIG. 6 is an exploded view of a radiating element circuit board. 21. In general, this embodiment may have an air suspended strip-line radiating element 602, and an air suspended strip-line combing network 604 operatively coupled to and located below the air suspended strip-line radiating element 602.

More particularly, the air suspended strip-line radiating element 602 may have an antenna radiating element 606 operatively coupled to at least one radiating element probe 608. Radiating element 602 also includes a set of cavities as indicated by 616. The air suspended stripline network 604 may have an upper box stripline structure 610 which also incorporates cavities 616 operatively coupled to the at least one radiating element probe 608, a combining network 612 operatively coupled to the upper box stripline structure 610, and a lower box stripline structure 614 operatively coupled to the combining network 612.

As illustrated in the exploded view in FIG. 6, a level 1 cavity may be constructed of very low mass materials suitable for lightweight antenna applications. The radiating element probe circuit board may be of similar construction and may be captured between level 1 cavity and level 2 cavity, as shown. The radiating element according to the present method and apparatus may be comprised mainly of air or vacuum with a very small percentage of circuit board materials, yielding an extremely low equivalent dielectric constant which provides this element design with lower RF losses and a broader band performance than achieved by prior devices.

This element also has a potential weight and structural advantage when compared to prior ring-slot elements. Because the radiating element cavities may be made of structural materials (i.e. composite materials) they form the structural stability for the antenna assembly.

A unique embodiment described is the realization of an RF combining network using "box strip-line" technology that operates at S-band frequencies, but uses "box strip-line" geometry optimized at 45 GHz and as shown in FIG. 6. Because of the broad-band capability described, the small physical structure that is optimized for 45 GHZ supports the S-band frequency requirements while maintaining low losses. The advantage is a substantial decrease in the physical size and weight of the combining network circuit when compared to the same network optimized for the larger "box structure" associated with the S-band frequency.

Figure 7:
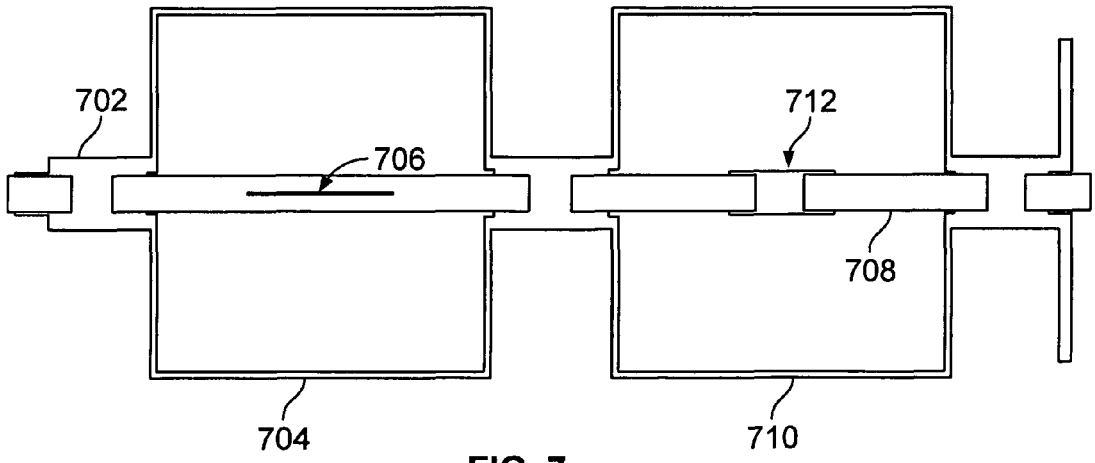
FIG. 7 is a cross section view of a box strip-line.

FIG. 7 is a cross section view of a box strip-line. In this example a copper plated through hole 702 or via is provided in a first copper plated box structure 704. Within the first copper plated box structure 704 is an embedded transmission line 706. The transmission line 706 is supported be a circuit board 708 that extend through the first copper plated box structure 704 and also through a second copper plated box structure 710. Within the second copper plated box structure 710 the circuit board 708 has a double registered transmission line 712.

As previously explained, the box strip-line may be used as the transmission line for the feed network and power combiner/divider as applicable of the low loss radiating elements. The embodiment depicted in FIG. 6 illustrates this network for a 7-element sub array but a similar concept may be applied for any number of elements. Coupling slots on the box strip-line walls may be used to couple RF energy from the feed network to the element. In other embodiments, the RF coupling may be realized via probes or connectors. The slot dimension, in this specific case, is designed for 2 GHz and the network is designed for 45 GHz that also supports 2 GHz frequency. The radiating element and the feed network may be of any frequency as desired. The element may also have a "parasitic patch" to extend the bandwidth of the element.

Figure 8:
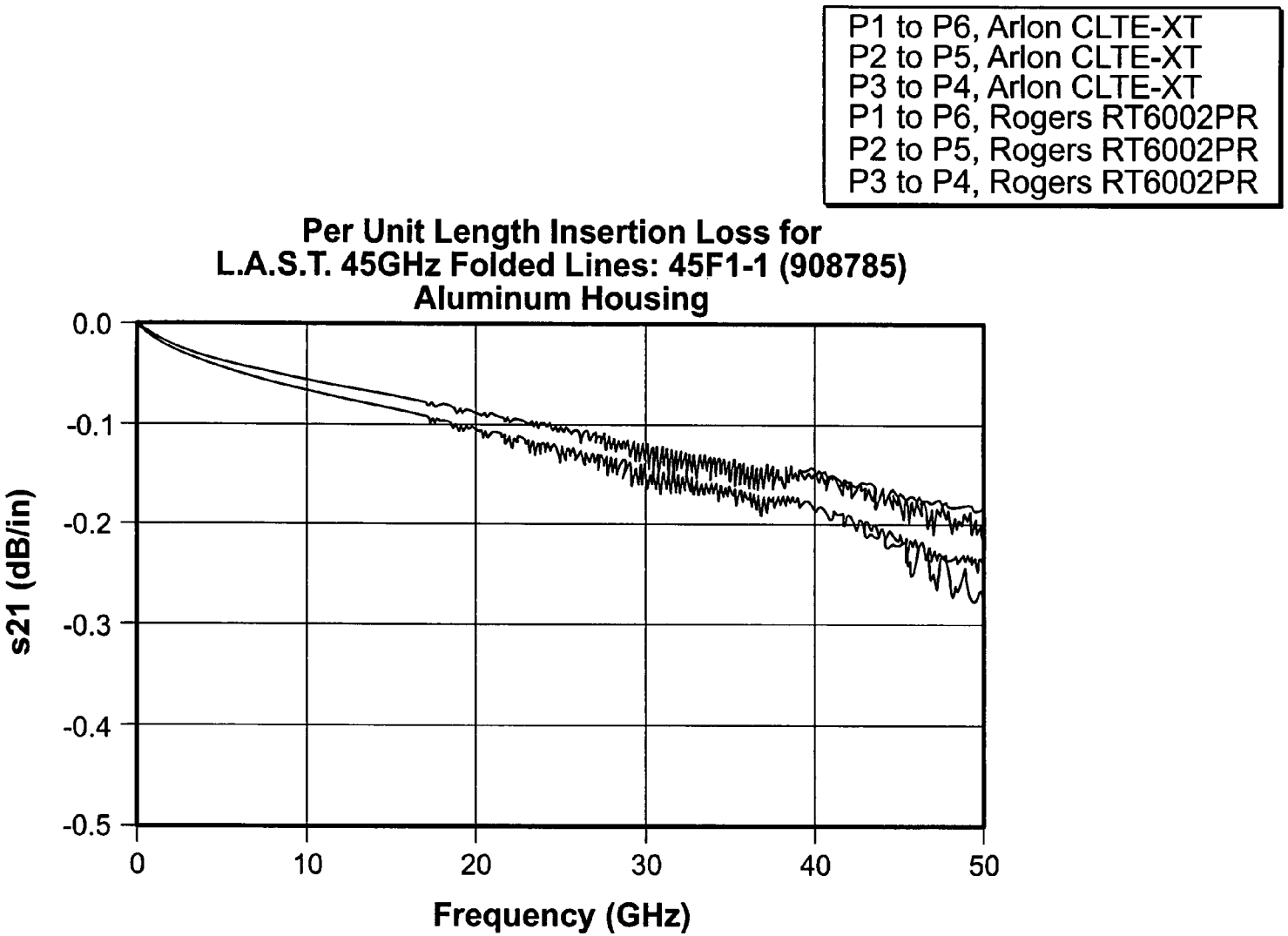
FIG. 8 depicts RF loss performance of a low loss box strip-line.

FIG. 8 shows the RF loss characteristic of the box strip-line. In one embodiment according to the present method and apparatus, the RF loss per inch is approximately 0.15 dB at 40 GHz range. This loss is significantly lower than that of microstrip, coaxial and square-axial lines that are typically employed in power combining networks. Furthermore, from bandwidth point of view, the box strip-line is preferable over a rectangular and circular waveguide.

Figure 9A:
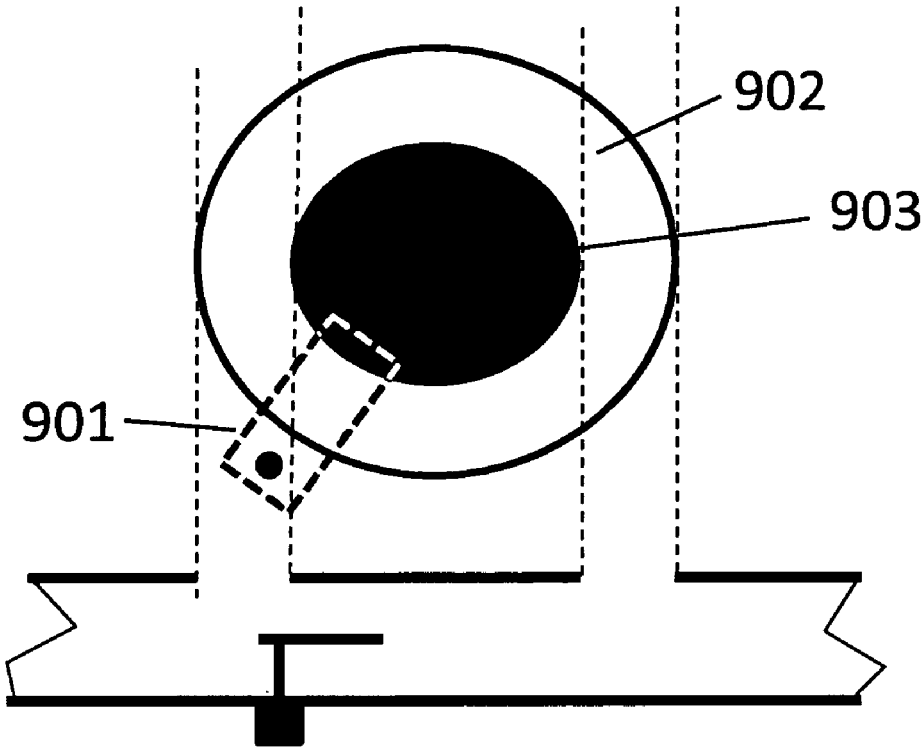
FIG. 9A depicts a ring slot radiator with an elliptical patch.
Figure 9B:
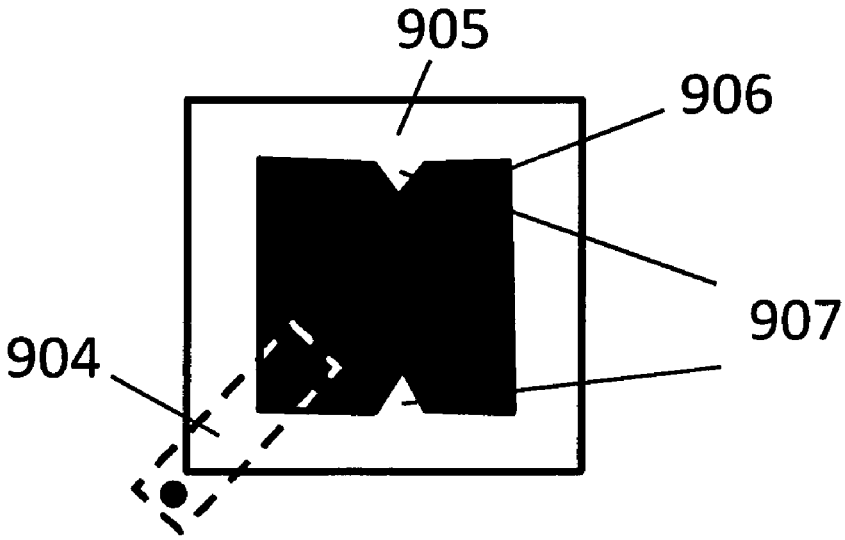
FIG. 9B depicts a ring slot radiator with a square patch with notches.

FIG. 9A shows top and side views of a ring slot radiator having a probe-fed strip 901, an elliptical slot 902 and an elliptical patch 903 for use in circular polarization. FIG. 9B shows another embodiment of the ring slot radiator having a probe-fed strip 904, a square slot 905, a square patch 906 that has notches 907. This configuration produces degenerate modes for circular polarization (CP) radiation. Such CP radiation can also be accomplished by a circular patch with notches and by corner cut square patches.

Figure 10A:
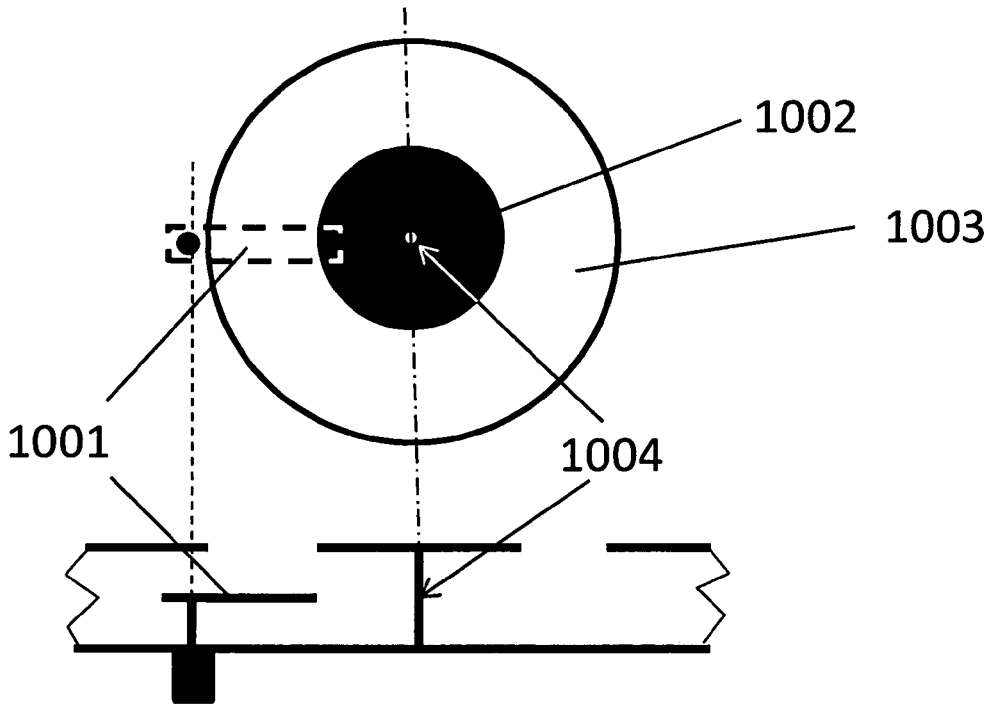
FIG. 10A depicts a ring slot radiator with a center via.
Figure 10B:
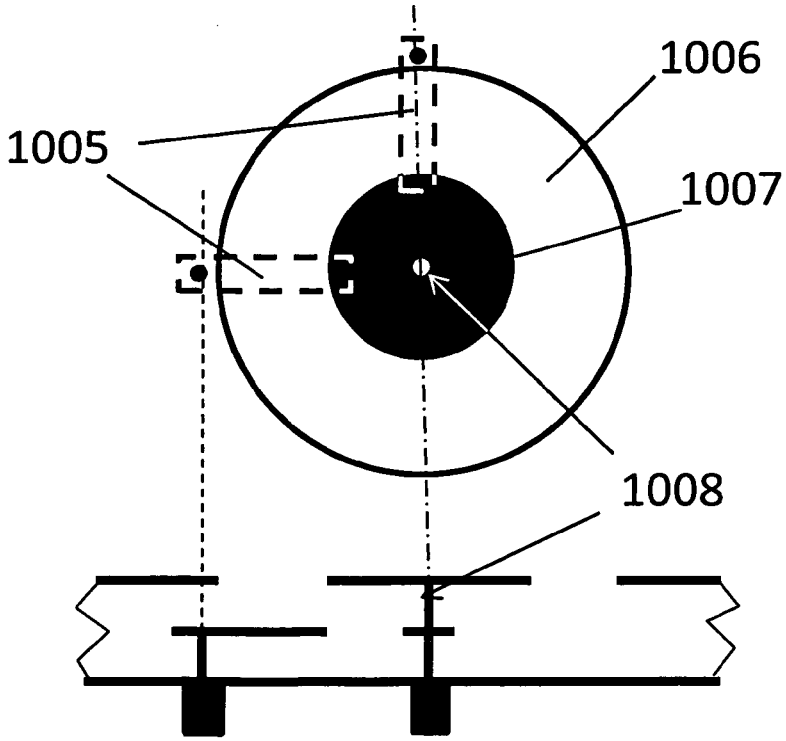
FIG. 10B depicts a ring slot radiator with dual linear polarization.

FIG. 1OA shows top and side views of a ring-slot radiator with a probe-fed slot 1001, a circular ring slot 1003, a circular patch 1002 and a center via 1004 to eliminate undesired mode for a good cross-polarization performance. FIG. 10B shows top and side views of a ring slot radiator having a circular slot 1006, circular patch 1007, center via 1008 and two feeds 1005 for dual linear polarization.

The present method and apparatus are not limited to the particular details of the depicted embodiments and other modifications and applications are contemplated. Certain other changes may be made in the above-described embodiments without departing from the true spirit and scope of the present method and apparatus herein involved. It is intended, therefore, that the subject matter in the above depiction shall be interpreted as illustrative and not in a limiting sense.

We claim:

1. An apparatus, comprising:

a ring-slot structure having at least one ring-slot opening on an infinite ground plane that forms a radiating element;

a probe-fed strip structure that excites the slot; another ground plane underneath the strip structure;

a plurality of suppression elements around the ring slot to suppress parallel plate and surface wave modes;

the radiating element having a characteristic of dual resonance, double-tuned in which the strip structure is an open ended strip and both the strip structure and a cavity are structured to resonate at at least two different frequencies; and two of the suppression elements of the plurality of suppression elements being two reactive posts that are positioned at a 45-degree angle relative to the strip structure.

2. The apparatus according to claim 1, wherein the radiating element has a patch, and wherein a shape of the patch is one of rectangular and elliptical, and wherein a shape of the ring-slot structure changes accordingly.

3. The apparatus according to claim 1, wherein the radiating element has a patch, and wherein a shape of the patch is circular.

4. The apparatus according to claim 1, wherein the radiating element has a patch, and wherein a shape of the patch is square.

5. The apparatus according to claim 1, wherein a shape of the radiating element is deformed with notches/ears.

6. The apparatus according to claim 1, wherein the two reactive posts also function as supports for a patch of the ring-slot structure in the case of air-filled cavity.

7. The apparatus according to claim 1, wherein the apparatus generates circular polarization radiation using mode degeneracy.

8. An apparatus, comprising:

a ring-slot structure having at least one ring-slot opening on an infinite ground plane that forms a radiating element;

a probe-fed strip structure that excites the slot; another ground plane underneath the strip structure;

a plurality of suppression elements around the ring slot to suppress parallel plate and surface wave modes;

the radiating element having a characteristic of dual resonance, double-tuned in which the strip structure is an open ended strip and both the strip structure and a cavity are structured to resonate at least two different frequencies; and the radiating element formed by a thin low-loss circuit board, the circuit board and plated through holes thereof suspended above a defined cavity;

wherein two of the suppression elements of the plurality of suppression elements are two reactive posts that are positioned at a 45-degree angle relative to the strip structure.

9. The apparatus according to claim 8, wherein the suppression elements are vias.

10. The apparatus according to claim 8, wherein the suppression elements are partial conductors of copper or aluminum plated surfaces.

11. The apparatus according to claim 8, wherein the strip structure is formed on a substrate, and wherein a substrate material of the substrate is a low permittivity material.

12. The apparatus according to claim 8, wherein the strip structure is formed on an air-substrate, and wherein a center via holds a circular patch region ring-slot structure on an upper ground plane.

13. The apparatus according to claim 8, wherein dimensions of a slot radii of the ring-slot opening and the strip structure are structured to provide dual resonance behavior of the ring-slot structure.

14. The apparatus according to claim 8, wherein, for bandwidth enhancement, another layer of parasitic patches is located above a radiating slot layer of the ring-slot structure.

15. The apparatus according to claim 8, wherein the ring-slot structure has approximately 10 dB return loss bandwidth that is about 21% of an operating frequency, and wherein the ring-slot structure has a bore-sight gain of about 6 dBi at a center frequency, which corresponds to about 100% aperture efficiency.

16. The apparatus according to claim 8, wherein the cavity is constructed of very low mass materials.

17. A method, comprising:

forming at least one radiating element from a ring-slot structure having at least one ring-slot opening on an infinite ground plane;

forming a probe-fed strip structure that excites the slot;

forming another ground plane underneath the strip structure;

forming a plurality of suppression elements around the ring slot to suppress parallel plate and surface wave modes; and obtaining circular polarization using mode degeneracy by placing two of the suppression elements as reactive posts at a 45-degree location relative to the strip structure;

wherein the radiating element has a characteristic of dual resonance, double-tuned in which the strip structure is an open ended strip and both the strip structure and a cavity are structured to resonate at at least two different frequencies.

18. The method according to claim 17, wherein a shape of the patch of the at least one radiating element is deformed with notches/ears.

* * * * *